US008398362B2

(12) United States Patent
Conrad et al.

(10) Patent No.: US 8,398,362 B2
(45) Date of Patent: Mar. 19, 2013

(54) TURBOMOLECULAR PUMP

(75) Inventors: Armin Conrad, Herborn (DE); Peter Fahrenbach, Braunfels (DE)

(73) Assignee: Pfeiffer Vacuum GmbH, Asslar (DE)

( * ) Notice: Subject to any disclaimer, the term of this patent is extended or adjusted under 35 U.S.C. 154(b) by 2383 days.

(21) Appl. No.: 11/079,649

(22) Filed: Mar. 14, 2005

(65) Prior Publication Data

US 2005/0207884 A1 Sep. 22, 2005

(30) Foreign Application Priority Data

Mar. 16, 2004 (DE) ..... 10 2004 012 713

(51) Int. Cl.
*F01D 1/36* (2006.01)

(52) U.S. Cl. ..... 415/90

(58) Field of Classification Search ..... 415/199.5, 415/90; 417/423.4
See application file for complete search history.

(56) References Cited

U.S. PATENT DOCUMENTS

| | | | | |
|---|---|---|---|---|
| 3,953,148 | A * | 4/1976 | Seippel et al. | 415/199.5 |
| 3,969,039 | A * | 7/1976 | Shoulders | 417/244 |
| 4,309,143 | A * | 1/1982 | Klatt et al. | 415/90 |
| 5,033,936 | A * | 7/1991 | Shinojima | 415/90 |
| 5,498,125 | A * | 3/1996 | Hablanian | 415/90 |
| 6,182,439 | B1 * | 2/2001 | Siga et al. | 60/39.182 |
| 6,676,368 | B2 * | 1/2004 | Carboneri et al. | 415/90 |
| 2004/0037695 | A1 * | 2/2004 | Beyer et al. | 415/90 |

FOREIGN PATENT DOCUMENTS

| | | |
|---|---|---|
| DE | 3402549 | 8/1985 |
| DE | 4206972 | 9/1992 |
| EP | 1004775 | 5/2000 |
| WO | 2004007130 | 1/2004 |

* cited by examiner

*Primary Examiner* — Edward Look
*Assistant Examiner* — Aaron R Eastman
(74) *Attorney, Agent, or Firm* — Abelman, Frayne & Schwab

(57) ABSTRACT

A turbomolecular pump includes a plurality of alternatively axially arranged one behind another, rotor and stator discs (8,9) provided with blades (10), with the blades (10) located in vicinity of the high vacuum side having a blade angle ($\alpha$) that is steeper than blade angle ($\alpha$) of the blades (10) located in vicinity of the vacuum side, and with the blade angle ($\alpha$) of the blades (10) located in the vicinity of the vacuum side (3) amounting to less than 8°.

7 Claims, 1 Drawing Sheet

TURBOMOLECULAR PUMP

RELATED APPLICATION

This application claims priority of German Application 10 2004 012 713.1 filed Mar. 16, 2004.

BACKGROUND OF THE INVENTION

1. Field of the Invention

The present invention relates to a turbomolecular pump including a plurality of alternatively axially arranged one behind another, rotor and stator discs provided with blades, with the blades located in vicinity of the high-vacuum side having a blade angle that is steeper than a blade angle of the blades located in the vicinity of the vacuum side. The present invention also relates to a method of manufacturing of rotor and stator discs provided with blades having such blade angles for the turbomolecular pump.

2. Description of the Prior Art

Turbomolecular pumps of the type described above are well known. E.g., such turbomolecular pumps are disclosed in German Publications DE 2 035 063 B3 and DE 27 17 366 B2. The blades of these pumps have a cross-section of a parallelogram. The blade angle amounts to, dependent on an axial position of the blade, from 25° to 40°.

German Publication DE 101 03 230 A1 discloses a turbomolecular pump in which the cross-section of a blade substantially deviates from a parallelogram and has a shape of a wing. The medium blade angle amounts to about 45°.

German Publication DE 72 37 362 U1 discloses a turbomolecular pump in which the blades of a first group of blades, which are arranged at a suction side, the so-called suction group A, have a blade angle from 30° to 40°, and the blades of a second group, so-called compression group B, include the blades of the remaining stages and having a blade angle from 17° to 30°. The second group, the compression group B, can be divided in two sub-groups the blades of which have a blade angle, respectively, from 25° to 30° and from 17° to 25°.

The turbomolecular pump of the model Alcatel ATH 1600M has flat blades with a blade angle greater than 19°.

Pump-active components of a turbomolecular pump are formed by rotor and stator discs which are provided with blades and which are alternatively axially arranged one behind the other. The pumping effect is obtained in a known manner by cooperation of the rotor and stator discs.

The main characteristics of a turbomolecular pump are compression ratio and suction speed. The characteristics are primarily determined by the following parameters: circumferential speed of the blade ring of the rotor discs, number of blades, blade angle of the blades, and stage distribution of different discs of the entire disc set. Within the stages, the blade angle of a blade diminishes from the suction opening to the outlet opening.

Heat is generated primarily in the compression or outlet stages. This heat can lead to an undesired heating of the rotor. Besides, at high fore-vacuum pressures, these stages are very important for the fore-vacuum compatibility and the consumption power. The conventional turbomolecular pumps are generally characterized by unsatisfactory fore-vacuum compatibility, high consumption power, and strong heating of the rotor.

Accordingly, an object of the present invention is to provide a turbomolecular pump in which a significant heat generation and consumption power are prevented and a good fore-vacuum compatibility and compression are obtained.

SUMMARY OF THE INVENTION

This and other objects of the present invention, which will become apparent hereinafter, are achieved by a significant reduction of the blade angle of the blades of the compression or outlet stage, with the blade angle amounting toward the vacuum side to less than 8°.

The more shallow blade angle has a number of positive results: firstly, at the same overlap ratio, the number of blades per disc is smaller despite a small disc height. In addition, swirling in the high pressure region is prevented which results in reduction of power consumption and in reduction of heat generation. Small disc and blade heights result in a smaller collision rate of the molecules and, thereby, in smaller losses. Finally, the small disc and blade heights result in smaller overall dimensions of the pump. The reduction in the number of indentation leads to a further reduction of compression power. Moreover, a robust construction of pump stages, resistant to dust and corrosive gases, becomes possible, which favorably influences the compression forces. The smaller is the number of blades, the smaller are axial compression forces that act on the blades and, thus, less energy is required for driving the turbomolecular pump. Overall, the present invention results in a compact construction, in improved power characteristics of the outlet stages and, thereby, of the entire pump.

A further improvement of the above-listed advantages can be achieved when the blade angle of blades toward the vacuum side is less than 6°.

The advantages of the present invention are particularly noticeable when the blade angle of the blades toward the vacuum side is less than 5°.

Generally, in the inventive turbomolecular pump, the blade angle of the blades amounts, toward the vacuum side, from 5.9° to 4.6°.

The reduction of the disc height means that the axial height of the blades is less than 5 mm, in particular, is equal to or is less than 4.5 mm and, in extreme case, varies from 3 mm to 4.5 mm.

Up to the present, the turbomolecular pump was provided with, e.g., 24 blades, with the pump diameter of 250 mm. Blades formed integral components of discs that have a thickness of at least 5 mm. With the inventive pump, it is possible to form the pump with 16 or even 12 blades at the same pump diameter as the diameter of a convention pump. At that, the axial disc height would amount only from 3 mm to 4.5 mm.

In the inventive turbomolecular pump, the blades can have a cross-section that at least resembles a parallelogram.

For forming such shallow angles or thin discs or even thinner blades, it is proposed to use a so-called high-speed cutting for manufacturing the discs, with which the material is removed without application of pressure to the workpiece.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
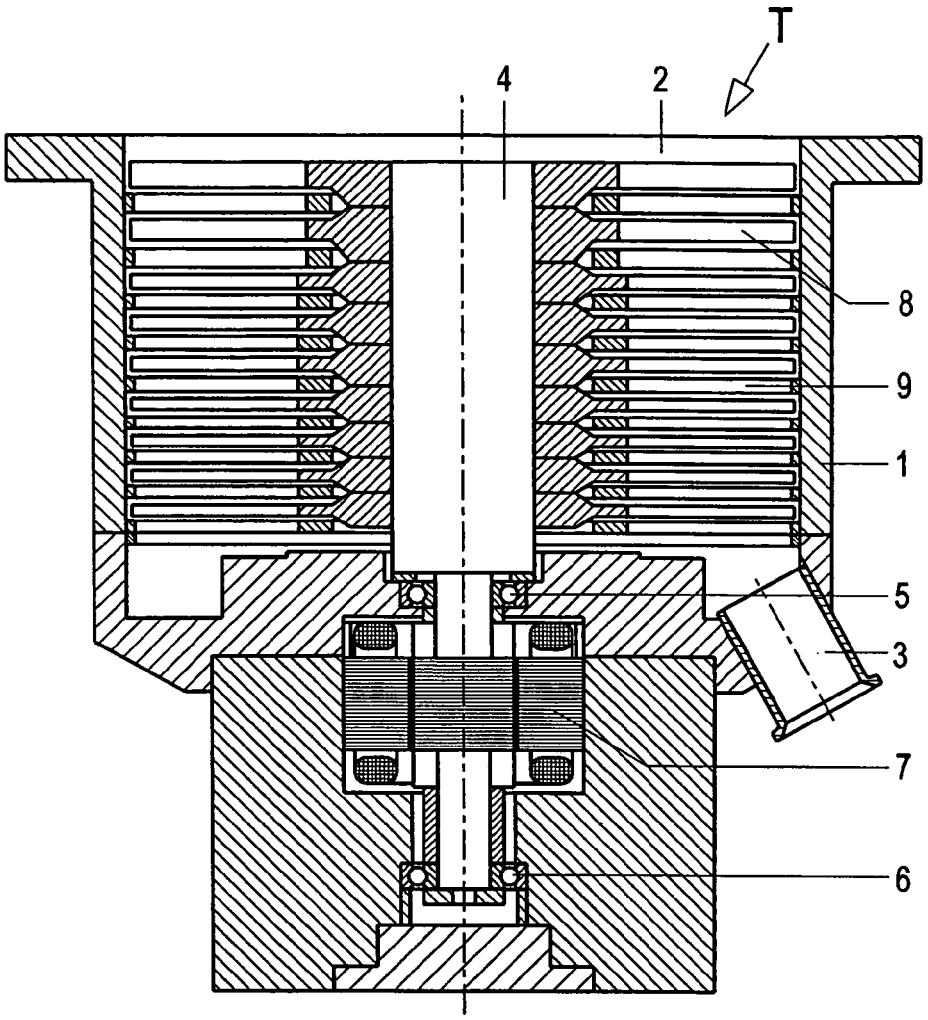
FIG. 1 a schematic axial cross-sectional view of a turbomolecular pump according to the present invention.

A turbomolecular pump T according to the present invention, which is shown in FIG. 1, has a housing 1 at one end of which corresponding to a high vacuum side of the pump, there is provided a suction flange 2 formed integrally with the housing, and at the other end of which corresponding to the vacuum side of the pump there is provided an outlet flange 3. A rotor shaft 4 is arranged in the housing 1 and is rotatably supported in roller bearings 5 and 6. An electric motor drive 7 drives the rotor shaft 4 with a high rotational speed. A plurality of rotor discs 8 are fixedly secured on the rotor shaft 4. The rotor discs 8 cooperate with stator disc 9 provided in the housing 1.

Figure 2:
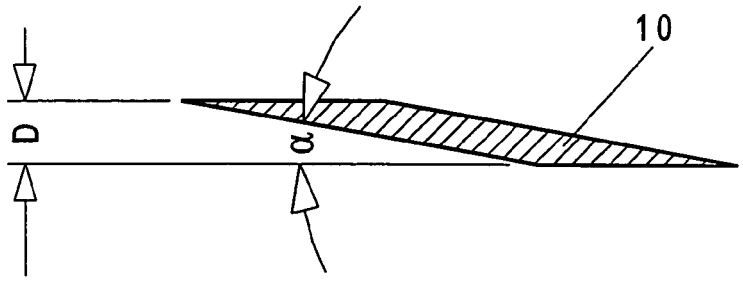
FIG. 2 a cross-sectional view of a blade of the turbomolecular pump shown in FIG. 1.

The groups of rotor discs 8 and stator discs 9, which are located adjacent to the pump outlet and to the outlet flange 3 have blades 10 with a blade angle between 4.6° and 5.9°. The blade angle $\alpha$ is shown in FIG. 2 at a substantially increased scale. The discs 8, 9 have height that amounts to from about 3 mm to about 4.5 mm and is determined by an axial height D of the blades 10.

The blades 10, which are located in the vicinity of the vacuum side, have a cross-section in form of a parallelogram having two opposite parallelogram angles each of which is less than 8 ° . For manufacturing the blades 8, 9 a so-called high-speed cutting is used, with which the material of the thin discs 8, 9 is removed without application of pressure to the discs, for producing the blades 10.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A turbomolecular pump, comprising a housing (1) having a high-vacuum side (2) and a vacuum side (3); and a plurality of alternatively axially arranged one behind another, rotor and stator discs (8,9) provided with blades (10), wherein the blades (10) located in vicinity of the high-vacuum side (2) have a blade angle ($\alpha$) that is steeper than a blade angle ($\alpha$) of the blades (10) located in vicinity of the vacuum side (3), wherein the blade angle ($\alpha$) of the blades (10) located in the vicinity of the vacuum side (3) amounts to less than 8°, and wherein an axial height (D) of the blades located in the vicinity of the vacuum side is less than 5 mm.

2. A turbomolecular pump according to claim 1, wherein the blade angle ($\alpha$) of the blades (10) located in the vicinity of the vacuum side (3) amounts to less than 6°.

3. A turbomolecular pump according to claim 2, wherein the blade angle ($\alpha$) of the blades (10) located in the vicinity of the vacuum side (3) amounts to less than 5°.

4. A turbomolecular pump according to claim 2, wherein the blade angle ($\alpha$) of the blades (10) located in the vicinity of the vacuum side (3) amounts to between 5.9° and 4.6°.

5. A turbomolecular pump according to claim 1, wherein the axial height (D) of the blades (10) is one of equal to 4.5 mm and less than 4.5 mm.

6. A turbomolecular pump according to claim 1, wherein the axial height (D) of the blades (10) amounts from 3 mm to about 4.5 mm.

7. A turbomolecular pump according to claim 1, wherein the blades (10), which are located in the vicinity of the vacuum side have a cross-section in form of a parallelogram opposite acute angles of which each is less than 8°.

* * * * *